US007055992B1

(12) United States Patent
Accornero

(10) Patent No.: US 7,055,992 B1
(45) Date of Patent: Jun. 6, 2006

(54) CORNER MOUNTED INDIRECT LIGHTING FIXTURE

(76) Inventor: John J. Accornero, 1004 Arroyo Dr., #3, So. Pasadena, CA (US) 91030

( * ) Notice: Subject to any disclaimer, the term of this patent is extended or adjusted under 35 U.S.C. 154(b) by 61 days.

(21) Appl. No.: 10/828,372

(22) Filed: Apr. 19, 2004

(51) Int. Cl.
*F21V 21/00* (2006.01)

(52) U.S. Cl. ..... 362/368

(58) Field of Classification Search ..... 362/368, 362/145, 147, 362, 370
See application file for complete search history.

(56) References Cited

U.S. PATENT DOCUMENTS 1,900,436 A 3/1933 Dourgnon
2,428,827 A 10/1947 Beck
2,800,577 A 7/1957 Block
3,334,542 A * 8/1967 Wenthe et al. ..... 355/70
4,217,629 A 8/1980 Russell
4,352,151 A * 9/1982 Lewis ..... 362/368
4,862,333 A 8/1989 Brasket
5,057,980 A * 10/1991 Russell ..... 362/147

* cited by examiner

*Primary Examiner*—Renee Luebke
*Assistant Examiner*—Leah S Lovell
(74) *Attorney, Agent, or Firm*—Jack C. Munro

(57) ABSTRACT

A corner mounted indirect lighting fixture which is to be mounted flush against the vertical walls of a corner of a house or building. The lighting fixture has a fixture housing which has a hook mounted on its exterior surface which is to engage with an engaging edge of a mounting bracket that is mounted at the corner formed by the vertical walls. The lighting fixture has an open top and a light diffusing plate at a bottom edge. A lamp is mounted to the fixture housing and extends within an internal chamber defined by the fixture housing. A translucent shade is attached to the fixture housing and defines the front wall surface of the internal chamber with a soft glowing light to be emitted outwardly therethrough.

3 Claims, 4 Drawing Sheets

CORNER MOUNTED INDIRECT LIGHTING FIXTURE

BACKGROUND OF THE INVENTION

1. Field of the Invention

This invention pertains to lighting fixtures and more particularly to a lighting fixture that is designed to function to emit indirect light rather as opposed to direct light.

2. Description of the Related Art

Lighting fixtures generally can be grouped into two different categories, an indirect lighting fixture and a direct lighting fixture. Direct lighting fixtures are designed to emit light directly at a particular object or area. Indirect lighting fixtures is a fixture that is designed to be placed at an obscure location and emit light at that obscure location. Generally in conjunction with houses and buildings, indirect lighting fixtures may be mounted adjacent a ceiling with light to be emitted at the ceiling. Also, it is known to construct an indirect lighting fixture to be located at a corner where two vertical walls of the house or building join.

Lighting fixtures that are mounted at corners not only are used to emit light but are also to be used to achieve an attractive external appearance. In other words, such lighting fixtures can be used as a decorator type of item for the house or building. In the past, the constructing of corner mounted lighting fixtures have given little consideration toward making use of all of the light that is emitted by the fixture. Also, such prior art corner mounted fixtures have a tendency to become hot due to the heat that is generated by the lamp within the fixture. This lamp is frequently mounted directly adjacent a sidewall of the fixture so that the sidewall and the vertical walls of the house or building on which it is mounted have a tendency to become heated, which may cause such to be discolored besides becoming also a potential fire hazard.

The primary objective of the present invention is to construct a corner mounted indirect lighting fixture which eliminates the possibility of overheating and also makes maximum use of the light that is emitted from the fixture.

SUMMARY OF THE INVENTION

The basic embodiment of corner mounted indirect lighting fixture of the present invention utilizes a mounting bracket which is adapted to be installed at a right angle junction between two vertical walls of a house or building. The mounting bracket has an engaging edge with a fixture housing to be supportingly mounted on this engaging edge. The fixture housing has an internal chamber which has an open top and is closed at the bottom by a diffusing plate. A lamp is mounted to the fixture housing and is located within the internal chamber. The lamp extends outwardly from the mounting bracket so that the glass bulb of the lamp is spaced from the fixture housing to decrease the possibility of heat being applied to the fixture housing. A shade is attached across the outer surface of the fixture housing. The shade is translucent to emit a soft appearing light from the lamp.

A further embodiment of the present invention is where the basic embodiment is modified by the fixture housing being constructed of a sheet material.

A further embodiment of the present invention is where the basic embodiment is modified by the sidewalls of the fixture housing being located vertical and be flush against the vertical walls of the house or building.

A further embodiment of the present invention is where the just previous embodiment is modified by each of the sidewalls of the fixture housing having a free edge which defines a pair of free edges, with these free edges being located parallel to each other.

A further embodiment of the present invention is where the basic embodiment is modified by the lamp being mounted at an inclined angle to locate the glass bulb near the top edge.

A further embodiment of the present invention is where the basic embodiment is modified by the diffusing plate comprising a screen which is constructed of polished metal or painted white.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figure 1:
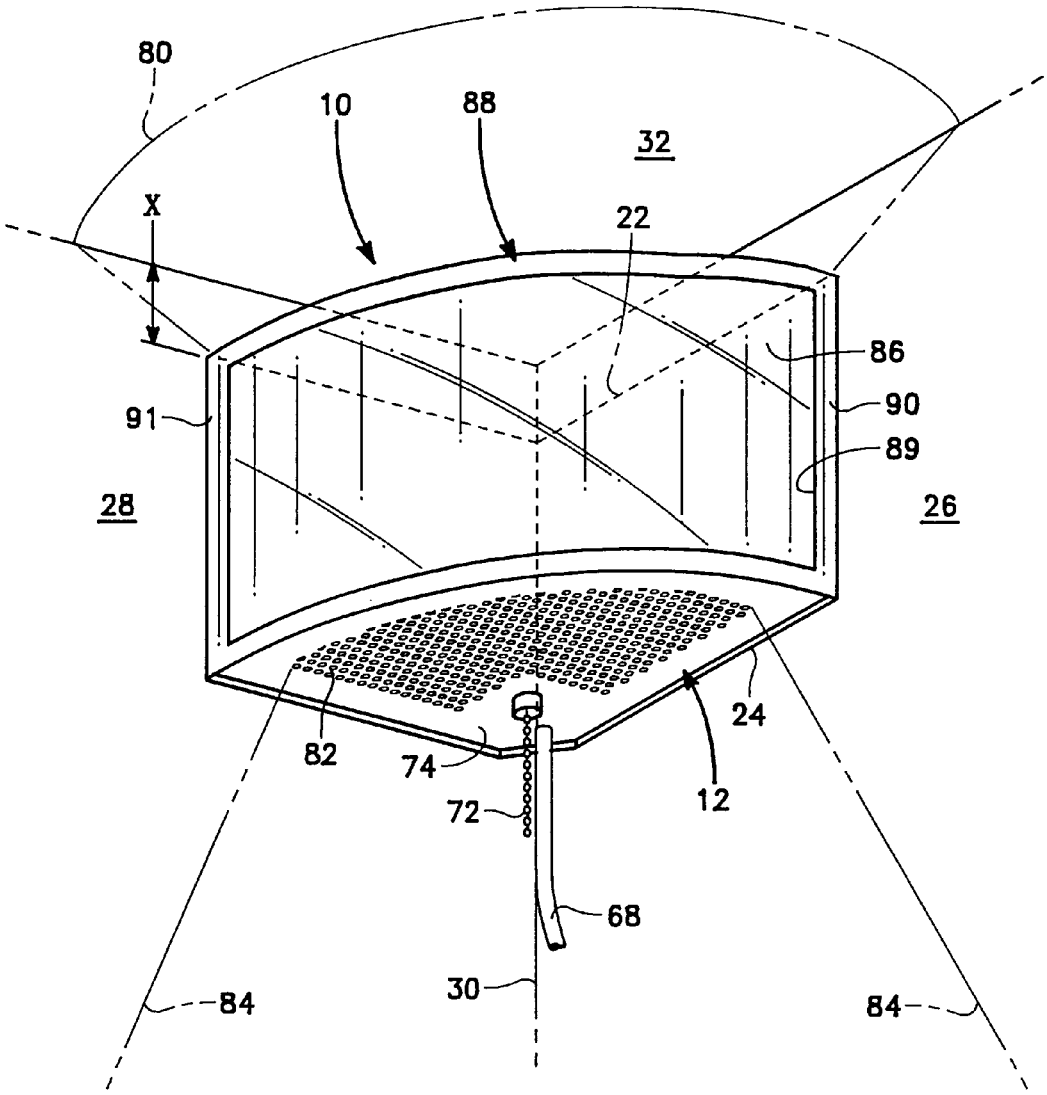
FIG. 1 is an exterior isometric view of the corner mounted indirect lighting fixture of the present invention showing such installed in conjunction with a wall corner of a house or building.
Figure 2:
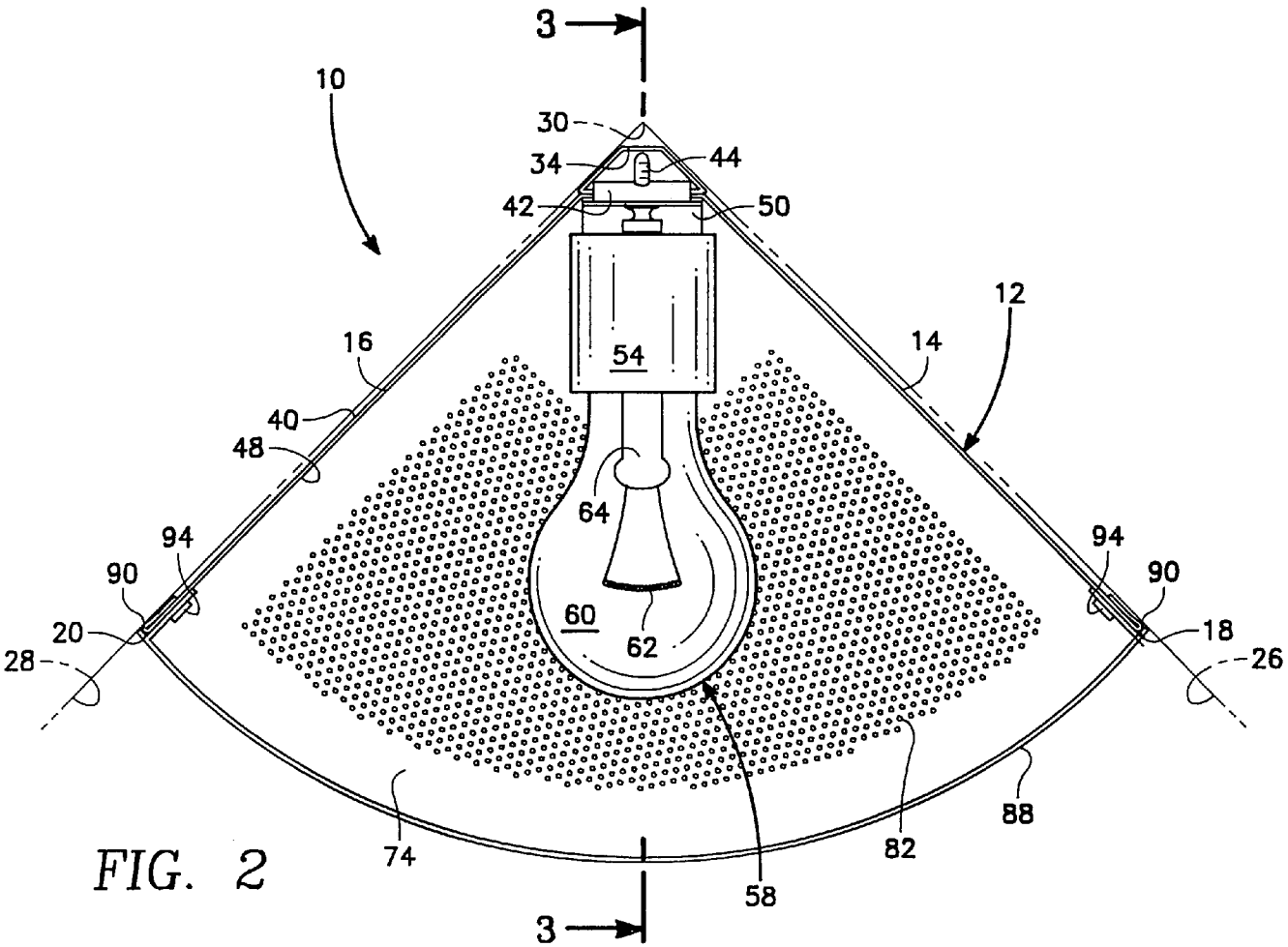
FIG. 2 is a top plan view of the corner mounted indirect lighting fixture of the present invention.
Figure 3:
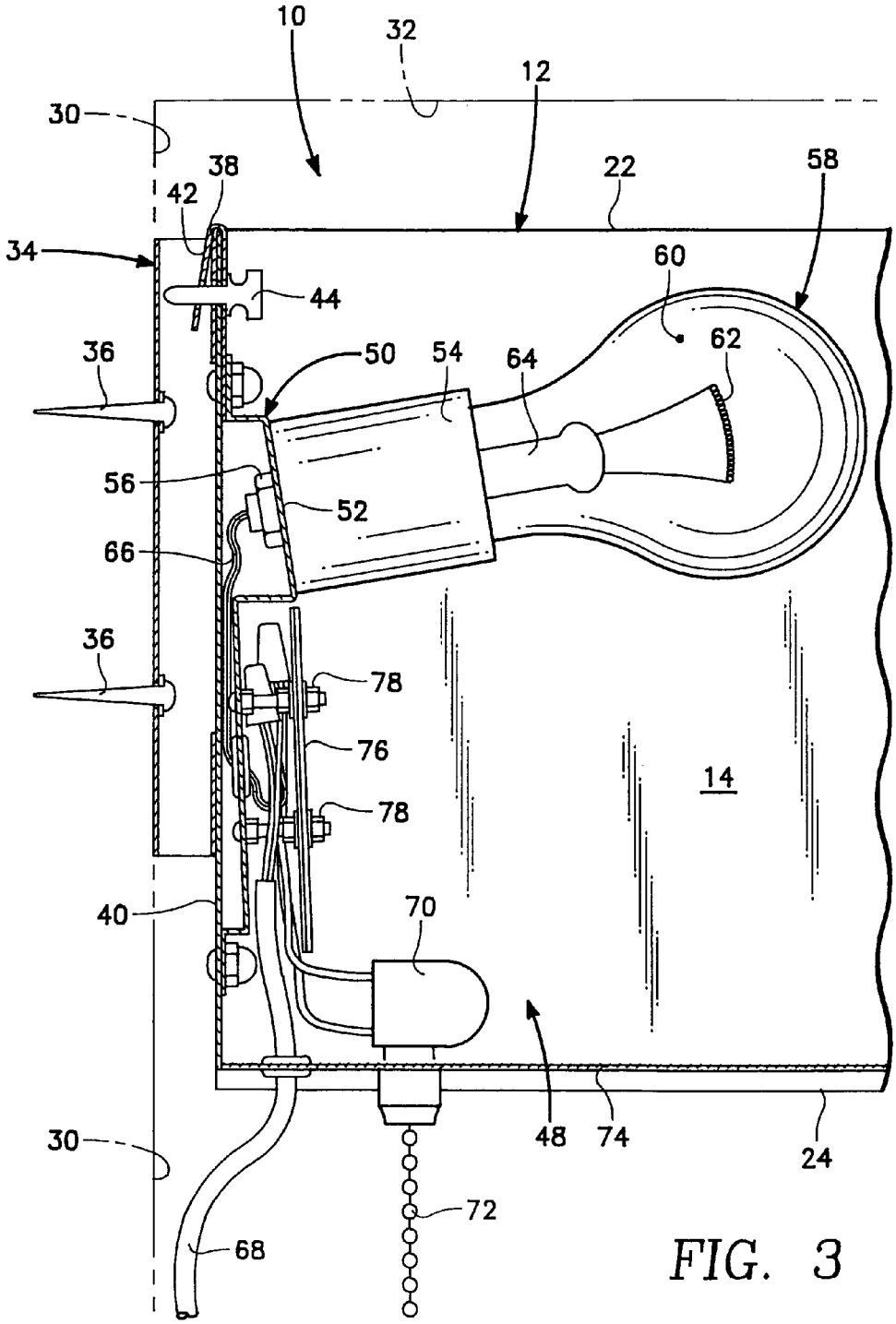
FIG. 3 is a longitudinal cross-sectional view taken along line 3—3 of FIG. 2.
Figure 4:
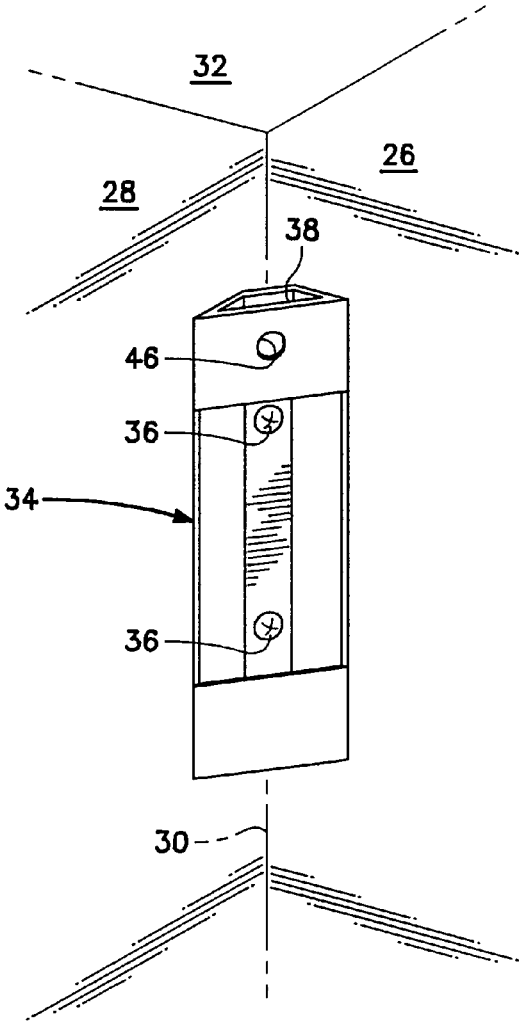
FIG. 4 is an isometric view of the mounting bracket that is utilized in conjunction with the lighting fixture of the present invention to mount such on the vertical walls of a house or building.
Figure 5:
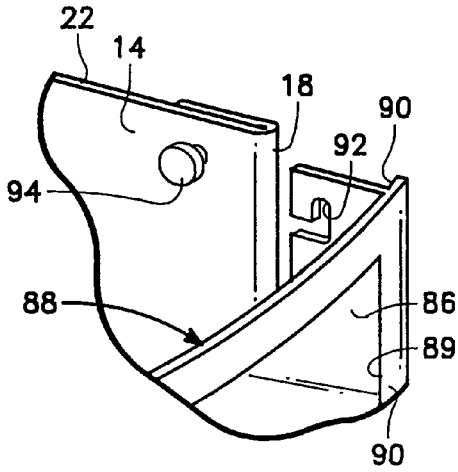
FIG. 5 is an exploded isometric view of a portion of the lighting fixture of the present invention showing the connection between the shade and the sidewall of the fixture housing with the shade not connected to the sidewall.
Figure 6:
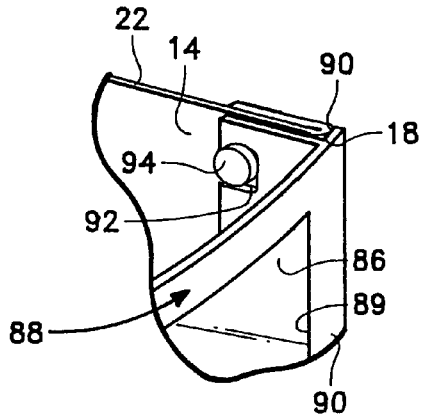
FIG. 6 is a view similar to FIG. 5 but showing the shade connected to the sidewall.

Referring particularly to the drawings, there is shown in FIG. 1 the lighting fixture 10 of this invention. Lighting fixture 10 has a fixture housing 12 which has a pair of sidewalls 14 and 16. Sidewalls 14 and 16 are each constructed of sheet material with generally a metallic material being preferred. However, a plastic material could also be used. The typical thickness of the sheet material sidewalls 14 and 16 will be no more than one-eighth of an inch. Each of the sidewalls 14 and 16 are of the same size and therefore define the same area. Each sidewall 14 and 16 has a free outer edge 18 and 20 respectively. The free outer edges 18 and 20 are parallel to each other. This means that the light that will be emitted from the top edge 22 will be basically the same amount that is emitted from the bottom edge 24.

The sidewall 14 is to abut against vertical wall 26 of a house or building. The sidewall 16 is to abut against vertical wall 28 of a house or building. The vertical walls 26 and 28 are joined in a right angle configuration at a corner 30. The vertical walls 26 and 28 extend directly to a ceiling 32.

A mounting bracket 34 has in transverse cross-section a trapezoidal shape. The mounting bracket 34 is to be attached by screw fasteners 36 to the corner 30. The mounting bracket 34 has an engaging edge 38. The exterior surface 40 has a hook 42 mounted thereon. Connecting with the hook 42 is a thumb bolt 44 which is threadingly mounted in conjunction with the fixture housing 12. The thumb bolt 44 is to threadably connect with a hole 46 formed within the mounting bracket 34. The thumb bolt 44 functions to fixedly secure the fixture housing 12 onto the mounting bracket 34.

The sidewalls 14 and 16 define an inner area which is being referred to as the internal chamber 48. Mounted to the fixture housing 12 and located within the internal chamber 48 is a lamp bracket 50. The lamp bracket 50 has an inclined surface 52. This inclined surface 52 is canted at generally five to ten degrees. A lamp socket 54 is fixedly mounted by a nut 56 onto the inclined surface 52. The socket 54 is capable of threadingly receiving a base (not shown) of a lamp 58. The lamp 58 includes a glass bulb 60. The glass bulb 60 encloses a chamber within which is located a filament 62 of the lamp 58. Applying electricity to the filament 62 causes the filament 62 to glow which will produce the light. The filament 62 is mounted on a filament base 64.

The lamp socket 54 electrically connects by wires 66 to an electrical cord 68 and also to a switch 70. Switch 70 is to be moved between an open and a closed position by pulling on a chain 72. The switch 70 is fixedly mounted within a bottom plate 74 which is located at the bottom edge 24 of the fixture housing 12. The bottom plate 74 includes a mass of holes 82. The light from lamp 58 is to pass through holes 82. The bottom plate 74 is designed to be constructed of similar to a screen material and can either be constructed of a polished metal or can be painted white. The reason for the polished surface or the painting white is so that the maximum reflection of the light from the bottom plate 74 will be obtained. The light that is emitted through the holes 82 will produce an illuminating pattern 84. The illuminating pattern 84 will be in the shape of a series of streams of light where the illuminating pattern 80 will comprise a single enlarged beam of light. The streams of light produced by the bottom plate 74 resemble a series of individual threads of light. The result is an overall desirable appearance is produced when one observes the different illuminating patterns 80 and 84. The electrical connections between the wires 66, switch 70 and cord 68 are covered by means of a cover plate 76 which is fixedly mounted by fasteners 78 to the lamp bracket 50. It is to be understood that the electrical cord 68 will be connected to an appropriate source of electricity, which is not shown.

It is to be noted that because of the slight inclination of the inclined surface 52 that the lamp 58 will locate the glass bulb 60 directly adjacent the top edge 22. The purpose for this is so that the maximum amount of light that is being generated from the lamp 58 will be emitted exteriorly of the top edge 22 and form an illuminating pattern 80 on the ceiling 32. The lighting fixture 10 is to be mounted a distance X from the ceiling 32 which could vary from a few inches to a few feet.

A third illuminating pattern is produced transversely outwardly through a translucent shade 86. The translucent shade 86 will generally be made of plastic glass material or even a thin metal. The shade 86 is to diffusingly disperse the light that is emitted from the lamp 58 giving a glowing appearance to the lighting fixture 10. The shade 86 is mounted within an enlarged opening 89 of a frame 88. The upper edge of the shade 86 and frame 88 is to be fixed in position by incorporating a bayonet slot 92 at each side of the shade 86. Each bayonet slot 92 is to engage with an enlarged headed protuberance 94 which functions to lock in place the upper portion of the shade 86 relative to the fixture housing 12. It is to be understood that there will be an enlarged headed protuberance 94 on the inside surface of both sidewall 14 and 16 directly adjacent the top edge 22. The frame 88 has side extensions 90 and 91 each of which is to cover respectively a free outer edge 18 and 20. The covering is to improve the appearance of the lighting fixture 10.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A corner mounted indirect lighting fixture comprising:

a mounting bracket adapted to be installed at a right angle junction between two vertical walls, said mounting bracket having an engaging edge;

a fixture housing having an internal chamber, said fixture housing having a pair of enlarged headed protuberances, said fixture housing having an exterior surface, a hook mounted on said exterior surface, said hook to hangingly engage with said engaging edge to supportingly secure said fixture housing to said mounting bracket, said fixture housing having a top edge and a bottom edge, a bottom plate mounted at said bottom edge, said bottom plate extending perpendicular from said fixture housing, said top edge being open;

a lamp mounted to said fixture housing, said lamp having a glass bulb, said lamp extending outwardly from said mounting bracket so said glass bulb is spaced from said fixture housing to decrease the possibility of heat being applied to said fixture housing during operation of said lamp, said lamp being mounted at an inclined angle to locate said glass bulb directly adjacent said top edge permitting maximum usage of the light emitted from said lamp that is emitted from top edge; and a shade attached to said fixture housing, said shade being translucent to emit a soft appearing glow from said lamp, said shade abutting against said bottom plate, said shade having a pair of bayonet slots with each bayonet slot to engage with an enlarged headed protuberance of said protuberances.

2. The corner mounted indirect lighting fixture as defined in claim 1 wherein:

said fixture housing having sidewalls, said sidewalls being vertically oriented so each said sidewall is to abut flush against a vertical wall of the two vertical walls on which the mounting bracket is adapted to be installed, each of said sidewalls having a free outer edge defining a pair of free edges, said free edges being parallel, said shade having side extensions each of which covers a free edge of said free edges.

3. The corner mounted indirect lighting fixture as defined in claim 1 wherein:

said bottom plate comprising a screen constructed of polished metal or painted white.

* * * * *